US011328837B2

(12) United States Patent
Elsaadani et al.

(10) Patent No.: US 11,328,837 B2
(45) Date of Patent: May 10, 2022

(54) FIRE RATED MULTICONDUCTOR CABLE

(71) Applicant: Nokia Shanghai Bell Co., Ltd., Shanghai (CN)

(72) Inventors: Asaad Elsaadani, Meriden, CT (US); Thomas Kuklo, Denver, NC (US)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 0 days.

(21) Appl. No.: 16/751,355

(22) Filed: Jan. 24, 2020

(65) Prior Publication Data

US 2021/0233682 A1 Jul. 29, 2021

(51) Int. Cl.

| | |
|---|---|
| ***H01B 7/295*** | (2006.01) |
| ***H01B 1/02*** | (2006.01) |
| ***H01B 3/12*** | (2006.01) |
| ***H01B 7/02*** | (2006.01) |
| ***H01B 7/18*** | (2006.01) |
| ***H01B 7/22*** | (2006.01) |

(52) U.S. Cl.

CPC ..... *H01B 7/295* (2013.01); *H01B 1/026* (2013.01); *H01B 3/12* (2013.01); *H01B 7/0241* (2013.01); *H01B 7/1875* (2013.01); *H01B 7/22* (2013.01)

(58) Field of Classification Search

CPC ..... H01B 7/0241; H01B 7/1875; H01B 3/12; H01B 11/1869; H01B 7/29; H01B 7/292; H01B 7/295

See application file for complete search history.

(56) References Cited

U.S. PATENT DOCUMENTS

| | | | | |
|---|---|---|---|---|
| 3,265,808 | A * | 8/1966 | Binch | H01B 13/16 174/105 R |
| 3,588,318 | A | 6/1971 | Ollis | |
| 4,034,153 | A | 7/1977 | Andres et al. | |
| 4,280,225 | A * | 7/1981 | Willis | H01Q 1/002 174/102 SP |
| 4,780,695 | A * | 10/1988 | Watari | H01Q 13/203 156/54 |
| 5,742,002 | A * | 4/1998 | Arredondo | H01B 11/1847 174/102 D |
| 6,051,795 | A * | 4/2000 | Fisher | H02G 3/081 16/2.1 |
| 9,330,818 | B2 * | 5/2016 | Scaglione | H01B 7/18 |
| 9,773,585 | B1 | 9/2017 | Rogers | |
| 10,606,005 | B1 * | 3/2020 | Martin Regalado | H01B 9/02 |

(Continued)

FOREIGN PATENT DOCUMENTS

| | | |
|---|---|---|
| GB | 2035666 A | 6/1980 |
| WO | 2019/047929 A1 | 3/2019 |

OTHER PUBLICATIONS

"System 1850"; https://www.nventthermal.co.in/products/fired-rated-wiring-cables/wiring-cables/index.aspx?id=tcm:450-27812&catid=tcm:450-17758-1024; 2 pgs.; Jan. 2020.

*Primary Examiner* — Paresh Paghadal

(74) *Attorney, Agent, or Firm* — Harrington & Smith

(57) ABSTRACT

A cable includes an inner conductor; a dielectric arranged around the inner conductor; an outer conductor annularly arranged around the dielectric; a plurality of tapes around the outer conductor, each tape providing a successive layer over and circumferentially surrounding an underlying tape or the outer conductor, wherein one of the tapes is a conductor; and a jacket encasing the plurality of tapes.

7 Claims, 6 Drawing Sheets

(56) References Cited

U.S. PATENT DOCUMENTS

| | | | | |
|---|---|---|---|---|
| 2013/0133918 | A1* | 5/2013 | Konnik | H01B 13/26 174/102 R |
| 2015/0060106 | A1 | 3/2015 | Polasky | |
| 2018/0174710 | A1* | 6/2018 | Rogers | H01B 11/1834 |
| 2018/0286536 | A1* | 10/2018 | Hazenfield | H01B 7/295 |
| 2018/0348460 | A1* | 12/2018 | Sahoo | G02B 6/4432 |
| 2020/0075196 | A1* | 3/2020 | Eitel | H01B 7/292 |
| 2020/0081209 | A1* | 3/2020 | Martin Regalado | H01B 9/005 |

* cited by examiner

FIRE RATED MULTICONDUCTOR CABLE

TECHNICAL FIELD

The exemplary and non-limiting embodiments described herein relate generally to multiconductor cable and, more particularly, to fire rated coaxial cable.

BACKGROUND

Organizations such as UL and NFPA develop standards by which products can be evaluated for safety and performance. The ANSI/UL 2196 test, for example, is directed to the performance of electrical circuit protective systems in fire events. The ANSI/UL 444 test, as another example, applies to single or multiple coaxial cables for telephone and other communication circuits for on-site customer systems. Also, the NFPA publishes various codes directed to fire alarms and signaling, emergency services communications, and building and construction safety codes. Generally, for a coaxial cable to be considered rated for use in electrical circuits that are intended to survive a fire situation, the cable is required to meet or exceed a minimum functionality threshold after exposure to a test fire and a fire hose stream blast per UL and NFPA tests, codes, and standards.

SUMMARY

The following summary is merely intended to be exemplary. The summary is not intended to limit the scope of the claims.

In accordance with one example embodiment, a cable comprises an inner conductor; a dielectric arranged around the inner conductor; an outer conductor annularly arranged around the dielectric; a plurality of tapes around the outer conductor, each tape providing a successive layer over and circumferentially surrounding an underlying tape or the outer conductor, wherein one of the tapes is a conductor; and a jacket encasing the plurality of tapes.

In another example embodiment, a fire rated multiconductor cable comprises a conductor, a plurality of concentrically arranged temperature resistive tapes covering the conductor, wherein one of the temperature resistive tapes is a further conductor, and a protective jacket concentrically arranged to cover the plurality of temperature resistive tapes. The conductor comprises a first conducting material comprising a wire or tube, a second conducting material annularly arranged around the first conducting material, and a dielectric configured as a rope and helically wound in an annular space between the first conducting material and the second conducting material.

In another example embodiment, a temperature resistive covering for a multiconductor cable comprises a first tape layer of ceramic or silica covering the multiconductor cable; a second tape layer of metal or metal alloy covering the first tape layer of ceramic or silica; a third tape layer of ceramic or silica covering the second tape layer of metal or metal alloy; a fourth tape layer of metal alloy covering the third tape layer of ceramic or silica; and a fire retardant jacket covering the fourth tape layer of metal alloy. The temperature resistive covering is heat resistant up to 1850° F.

BRIEF DESCRIPTION OF THE DRAWINGS

The foregoing aspects and other features are explained in the following description, taken in connection with the accompanying drawings, wherein.

DETAILED DESCRIPTION OF EMBODIMENT

Figure 1:
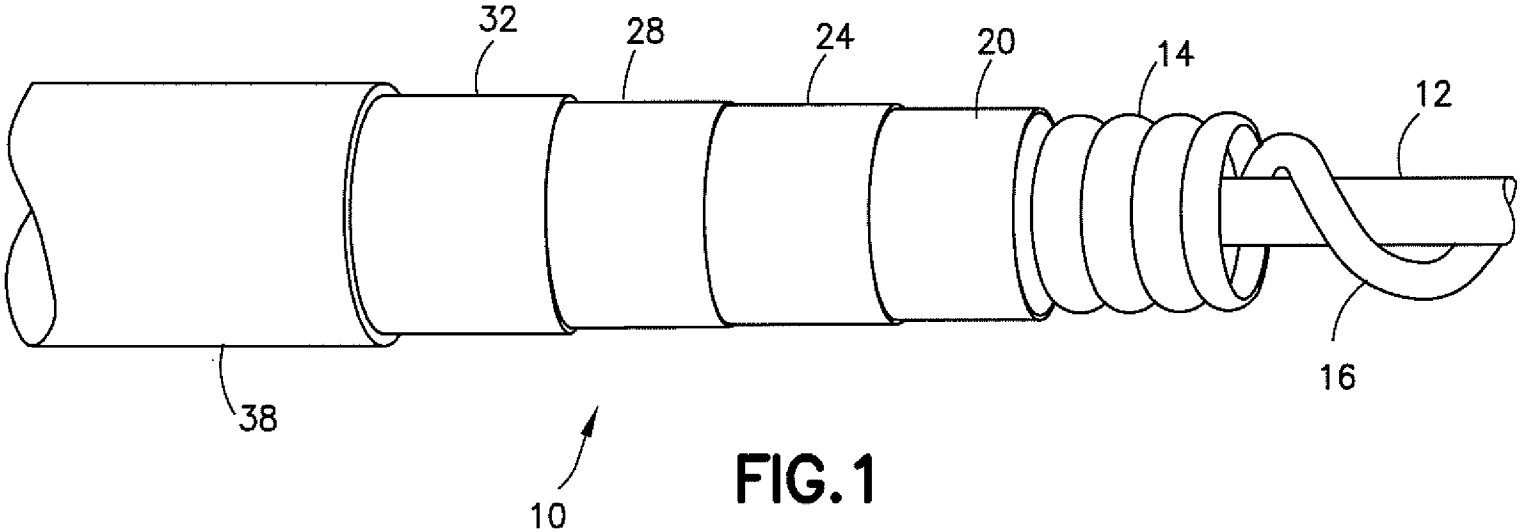
FIG. 1 is a perspective cutaway view of a one example embodiment of a coaxial cable.

The word "exemplary" is used herein to mean "serving as an example, instance, or illustration." Any embodiment described herein as "exemplary" or as an "example" is not necessarily to be construed as preferred or advantageous over other embodiments. All of the embodiments described in this Detailed Description are exemplary embodiments provided to enable persons skilled in the art to make or use the invention and not to limit the scope of the invention which is defined by the claims.

The ANSI/UL 2196 test is designed to evaluate electrical circuit systems when the system is exposed to fire followed by the mechanical shock of a water stream. Currently, no coaxial cable (hereinafter "coaxial cable" or "cable") in the industry is known to the inventors that meets the standards set by the ANSI/UL 2196 test. Deviations to meet the requirements set forth by the ANSI/UL 2196 test include the use of UL rated conduit with fire retardant tape material or the use of plenums made of fire rated construction materials within the buildings themselves with the cables routed inside the plenums. In some efforts to meet the requirements set forth by the ANSI/UL 2196 test, the coaxial cable is encased in an expensive phenolic conduit.

However, although coaxial cable encased in phenolic conduit may meet the ANSI/UL 2196 test, this arrangement may not pass standards developed by the NFPA, particularly NFPA 72®, Chapter 24 (directed to national fire alarm and signaling codes) and NFPA 1221 (directed to standards for the installation, maintenance, and use of emergency services communications systems), nor is it expected to meet the NFPA 5000® requirements (directed to building construction and safety codes). The main reason behind this is the temperature inside the conduit will be too extreme (around 1850° F.) and the plastic dielectric material at those temperatures will melt and char causing the inner conductor to short with the outer conductor, thereby compromising electrical communication through the cable. Furthermore, copper conductors used in such cables are prone to oxidize, thereby causing the copper to react with air to form cupric oxide which makes the conductor brittle, thus causing the conductor to break, which results in an open circuit.

Attempts have been made to design cables to meet the specifications set forth by the NFPA, though such cables were not able to be easily manufactured and were also very rigid for the applications intended. Such cables used insulating materials made of thermoplastic compounds filled with mineral particles (ceramic or glass) or inserted ceramic disks made of ceramic material.

Example embodiments of cables disclosed herein are expected not only to survive fire situations but further to meet or exceed ANSI/UL 2196, NFPA 72®, Chapter 24, NFPA 1221, and potentially NFPA 5000® requirements so that such cables may be used for in-building emergency communication systems and the like. This new solution for coaxial cable certified under ANSI/UL 2196 and NFPA codes may revolutionize the in-building communications industry that is required to meet new fire safety standards. The example embodiments of the cables disclosed herein are also expected to be beneficial to other areas that would demand high temperature applications.

In the ANSI/UL 2196 test, for example, coaxial cable having an inner conductor and an outer conductor is exposed to fire for two hours and is followed by the mechanical shock of a blast from a water hose stream. Pin holes may be present in weld lines on the outer conductor. The temperature of the cable at the end of the exposure to fire will be 1850° F. Upon application of the hose stream blast and exposing the cable at 1850° F. to the water, the pressure will drop and cause a vacuum in the cable. Water on the outside of the cable will convert to steam, which will be drawn (due to the lower pressure) through the pin holes, thus causing the steam to condense around the ceramic dielectric. The presence of this water (condensed from the steam) on the ceramic dielectric will reduce the insulation resistance between the inner conductor and the outer conductor.

The foregoing mechanism may be based on the ideal gas law:

$$PV=MRT \quad \text{(Equation 1)}$$

where P=pressure, V=air volume inside the cable between the inner conductor and the outer conductor, T=temperature, M=the mass of air inside the cable, and R is a constant. The following relationship may also apply:

$$P_2/P_1=T_2/T_1 \quad \text{(Equation 2)}$$

where $P_1$=pressure before the hose stream, $P_2$=pressure after the hose stream, $T_1$=temperature before the hose stream, and $T_2$=temperature after the hose stream. As indicated in Equation 1 (where $P_1$=1 atmosphere (1 Atm) and $T_1$=1283 K (1850° F.)), the pressure at the exterior of and around the coaxial cable will be 1 Atm, and the pressure inside the coaxial cable will be 0.2 Atm. As indicated in Equation 2, the pressure drop is equivalent to the ratio of the cable temperature before and after the hose stream portion of the test. Thus, the vacuum V created by a sudden drop in temperature will force the steam vapor and air to be drawn into the cable through holes in the outer conductor. A lack of protection around the outer conductor may also lead to permeation of the water into the cable during the hose stream portion of the test.

Figure 2:
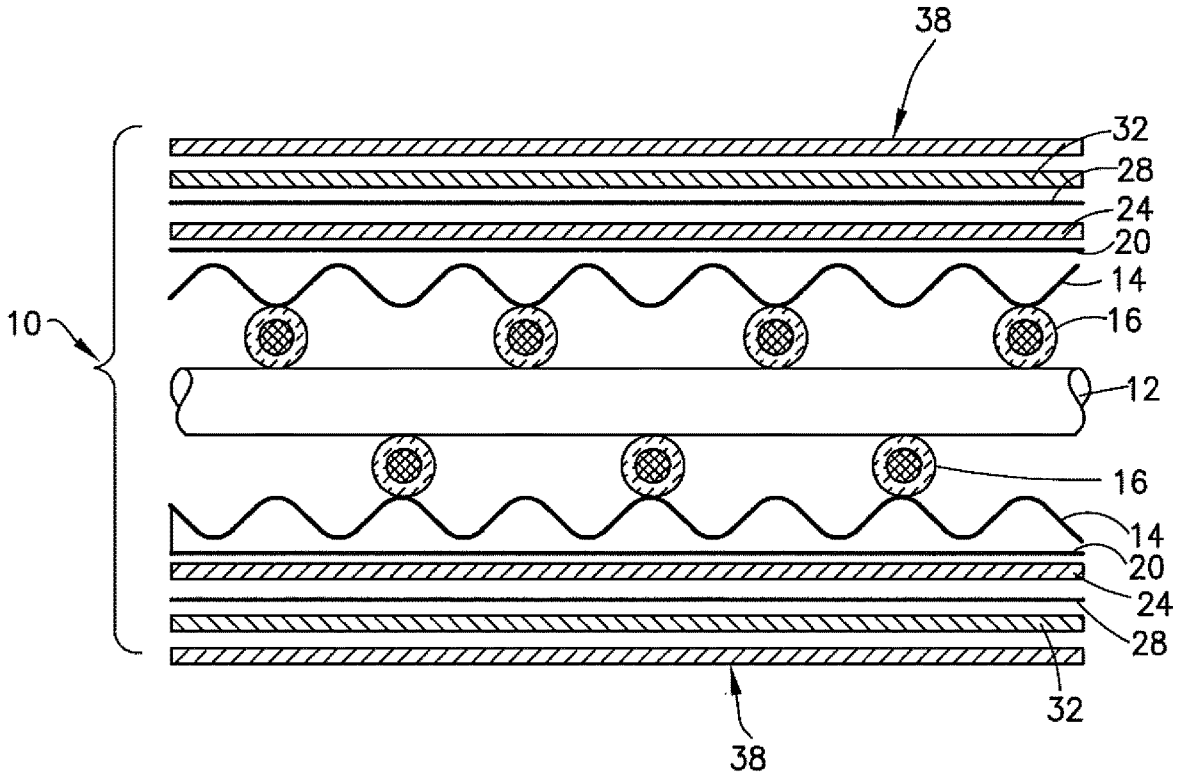
FIG. 2 is a schematic view of the coaxial cable of FIG. 1.

Referring to FIGS. 1 and 2, one example embodiment of a coaxial cable is shown generally at 10 and is hereinafter referred to as "cable 10." Cable 10 may be RF cable for carrying RF signal, or it may be AC cable (an assembly of insulated conductors (for example, a three-phase cable having three conductors and a ground wire) in a flexible metallic sheath) and may be used to carry AC.

Cable 10 comprises an inner conductor 12 and an outer conductor 14 separated by a dielectric 16. Inner conductor 12 may be a solid wire or tube extending through a tubular configuration of the outer conductor 14. The inner conductor 12 may be copper or copper alloy.

The inner conductor 12 is encased by and isolated from the outer conductor 14 by the dielectric 16, which extends in an annular space between the inner conductor 12 and the outer conductor 14 along at least a length of the inner conductor 12. In ordinary configurations, the dielectric in coaxial cable is designed to maintain an air gap between the inner conductor and the outer conductor by means of helically wound insulation (or other dielectric means) in order to maintain a calculated and characteristic impedance in the cable. However, such dielectric insulation is typically unable to survive extreme heat conditions (such as temperatures around 1850° F.) and will generally start melting around 300° F., which will in turn short circuit the inner conductor to the outer conductor. When this happens, communication through the cable will be lost. Other choices of dielectric material that may withstand high temperatures and that have sufficient strength to maintain the characteristic impedance generally exhibit high attenuation at normal temperatures.

In the example embodiments herein, to prevent short circuit occurrences between the inner conductor 12 and the outer conductor 14 at high temperatures, the dielectric 16 may be fabricated of a material capable of withstanding the high temperatures, the material being arranged accordingly between the conductors. Also, the dielectric may be used with high temperature resistive barrier tapes and jacketed so as to protect the overall assembly of the cable 10. In addition to performance considerations of various dielectric insulation materials as well as jacket materials, the cable 10 is configured to be sufficiently flexible to allow for routing through tight spaces during installation.

In the example embodiments as described herein, the dielectric 16 may be a material extruded into a rope form and helically wound around the length of the inner conductor 12 to ensure that an air gap is formed between the inner conductor 12 and the outer conductor 14 and will be maintained at extreme temperatures. The material of the dielectric may be ceramic, silica ($SiO_2$), silicate ($SiO_3$, a compound containing an anionic silicon compound, which may be an oxide, but hexafluorosilicate ($[SiF_6]^{2-}$) and other anions are also included), or a hybrid of ceramic and silica (for example, aluminum oxide and silicon dioxide).

The outer conductor 14 overlays the dielectric 16 and may be helically or annularly corrugated. The material of the outer conductor 14 may be copper, corrugated copper, or copper clad stainless steel (such as 304, 316, or A606 steel tape).

Cable 10 also comprises a plurality of the high temperature resistive barrier tapes or sleeves successively layered and concentrically arranged over an underlying barrier tape with the innermost barrier tape layered over the outer conductor 14. In layering the tapes, the underlying layer is completely covered or at least substantially completely covered. The innermost barrier tape is a first barrier tape 20 positioned on an outer surface of the outer conductor 14 surrounding a circumference of the outer conductor 14 and extending over a length of the outer conductor 14. The first barrier tape 20 comprises ceramic or silica (for example, ceramic fibers, ceramic oxide fibers, amorphous silica glass having a $SiO_2$ content of greater than 99.95%, aluminoborosilicates, alumina silica, alumina, and the like) to isolate the outer conductor 14 from fire and water. The material of the first barrier tape 20 may have a fire rating so as to not burn (for example, the material of the first barrier tape 20 may be fire rated to 1700° C.).

A second barrier tape 24 may be disposed on the first barrier tape 20 so as to surround the first barrier tape 20 over a length thereof (similar to the first barrier tape 20). The second barrier tape 24 may comprise copper, stainless steel, or copper clad stainless steel.

A third barrier tape 28 may be disposed on the second barrier tape 24 similar to the second barrier tape 24 on the first barrier tape 20, the third barrier tape 28 comprising additional ceramic or silica material to isolate the outer conductor 14 and the underlying first barrier tape 20 and second barrier tape 24 from fire and water.

A fourth barrier tape 32 may be disposed on the third barrier tape 28 similar to the underlying barrier tapes, the fourth barrier tape 32 comprising a metal alloy such as stainless steel. The material of the fourth barrier tape 32 may function as a ground conductor.

A jacket 38 may be concentrically arranged on the fourth barrier tape 32 to encase the inner conductor 12, outer conductor 14, and dielectric 16, as well as the underlying barrier tapes 20, 24, 28, and 32. Jacket 38 may comprise a fire retardant material and may be applied to or disposed on the fourth barrier tape 32 to provide additional mechanical strength and fire protection to the cable 10. In case of fire (either due to the ANSI/UL 2196 test or a fire event during use of the cable 10), the jacket 38 will convert to ash, and the metal of the fourth barrier tape 32 may be damaged by exposure to fire and water. Underlying layers (the first barrier tape 20, the second barrier tape 24, and the third barrier tape 28) may be minimally damaged or experience no damage at all. Jacket 38 may also provide a surface for marking the cable 10. The fire retardant material of the jacket 38 may be, for example, ethylene copolymers, such as ethylene acrylic elastomer, polyvinyl chloride (PVC), polyvinylidene difluoride (PVDF), fire-resistant polyethylene (FRPE), or the like.

Figure 3:
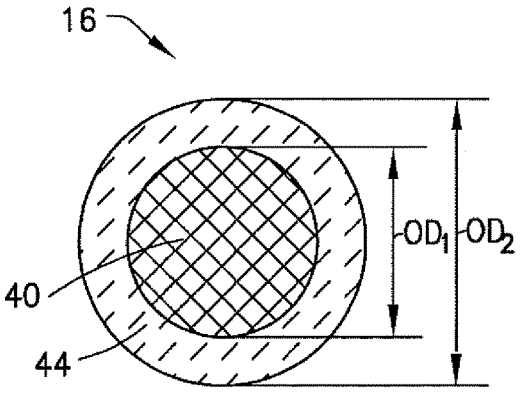
FIG. 3 is a schematic view of one example embodiment of a dielectric of the coaxial cable of FIG. 1.

Referring to FIG. 3, in one example embodiment, the dielectric 16 may be a hybrid rope comprising a core 40 having an outer diameter $OD_1$ of about 3 mm and comprising silica or other material. The core 40 may be surrounded, wrapped, or otherwise encased in an outer layer 44 comprising a ceramic material. An overall $OD_2$ of the hybrid rope dielectric 16, comprised of the core 40 surrounded by the outer layer 44, may be about 4.2 mm to about 4.6 mm.

Referring to FIGS. 1-3, barrier tapes such as the first barrier tape 20, the second barrier tape 24, and the third barrier tape 28 fabricated of ceramic or silica material, when positioned between the outer conductor 14 and the metal fourth barrier tape 32, may protect the outer conductor 14, the dielectric 16, and the inner conductor 12 against effects of fire and the subsequent application of water. Thicknesses of the ceramic and/or silica barrier tapes 20, 24, 28 and/or the fourth barrier tape 32 are generally very thin such that an increase in the overall $OD_2$ dimension due to the application of the four barrier tapes 20, 24, 28, and 32 will be very small (generally 1 millimeter (mm) or less) and will generally provide protection of the cable 10 from fire, oxidation, and water during the ANSI/UL 2196 test. The use of multiple barrier tapes protects the inner conductor 12 from oxidation and water intrusion at least in part because the ceramic material(s) of the barrier tapes do not burn, and the combination of multiple ceramic tapes provide a substantially airtight barrier, thus preventing air and water from contacting the outer conductor and the inner conductor 12.

Figure 4:
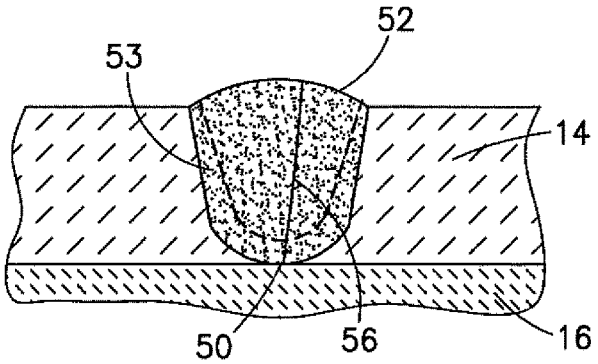
FIG. 4 is a schematic view of pin holes in a dielectric located between an inner conductor and an outer conductor of a coaxial cable.

Referring to FIG. 4, the ceramic material of the dielectric 16 located between the inner conductor 12 and the outer conductor 14 may be exposed to water via holes in the outer conductor 14. As shown, a weld 52 may be applied to the outer conductor 14 during processing or assembly of the cable 10. A region 53 at the interface of the weld 52 and the outer conductor 14, which is a mixture of the material of the weld 52 and the material of the outer conductor 14, may be compromised by a crack or other defect 56 extending from the dielectric 16, thereby allowing one or more pin holes 50 to form. The presence of at least one of the first barrier tape 20, the second barrier tape 24, the third barrier tape 28, and the fourth barrier tape 32, as well as the jacket 38, may prevent water intrusion through the pin holes 50 during the water hose portion of the ANSI/UL 2196 test.

The cable 10 is subjected to a flame in an oven 60 for two hours during an initial stage of the ANSI/UL 2196 test. Following the cable 10 being subjected to the flame in the oven 60 during the UL 2196 test, the cable 10 is subjected to a water hose stream blast 62. The water from such a blast 62 is generally destructive to the cable 10 and changes instantaneously to water vapor. A cable 10 considered as passing the ANSI/UL 2196 test and therefor attaining a fire rating would be one that continues to conduct a signal upon completion of the ANSI/UL 2196 test.

Figure 5A:
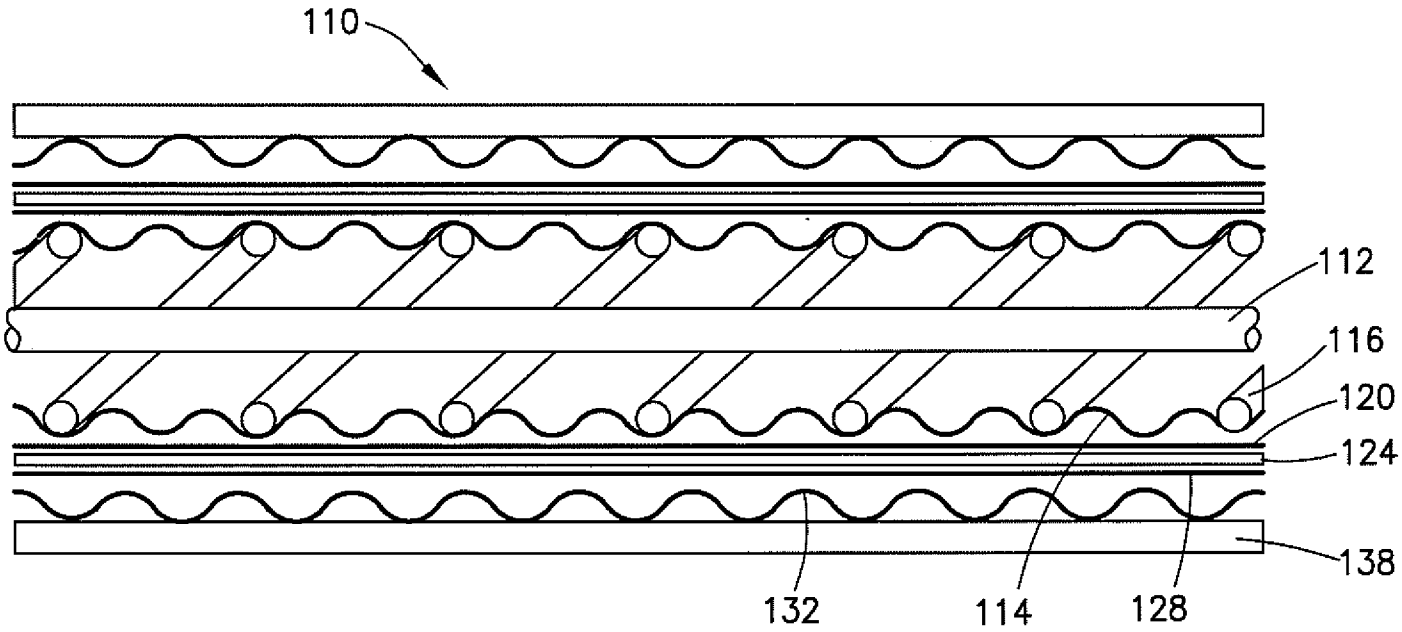
FIG. 5A is a schematic view of another example embodiment of a coaxial cable.

Referring to FIG. 5A, another example embodiment of a coaxial cable is shown generally at 110 and is hereinafter referred to as "cable 110." Cable 110 may be RF cable for carrying RF signal, or it may be AC cable (as with foregoing example embodiments).

Cable 110 comprises an inner conductor 112 and an outer conductor 114 separated by a dielectric 116. Inner conductor 112 may be a solid wire or tube extending through a tubular configuration of the outer conductor 114. The inner conductor 112 may be copper or copper alloy, and the outer conductor 114 may be copper or copper clad stainless steel in corrugated form. The dielectric 116 may be ceramic, silica, or a hybrid of ceramic and silica.

The resistive barriers arranged over the underlying outer conductor 114 include a first barrier tape 120 comprising silica. A second barrier tape 124 may be disposed on the first barrier tape 120, the second barrier tape 124 comprising copper, stainless steel, or copper clad stainless steel. A third barrier tape 128 may be disposed on the second barrier tape, the third barrier tape 128 comprising additional ceramic or silica material. A fourth barrier tape 132 on the third barrier tape 128, in this example embodiment, may be stainless steel in a corrugated form. While stainless steel exhibits ability in resisting corrosion, other materials such as copper, copper alloy stainless steel or copper clad stainless steel may also be used. Corrugations in the fourth barrier tape 132, as well as corrugations in the outer conductor 114, facilitate bending and flexing of the cable 110. A jacket 138 on the fourth barrier tape 132 may be, for example, ethylene acrylic elastomer, PVC, PVDF, FRPE, or the like.

Figure 5B:
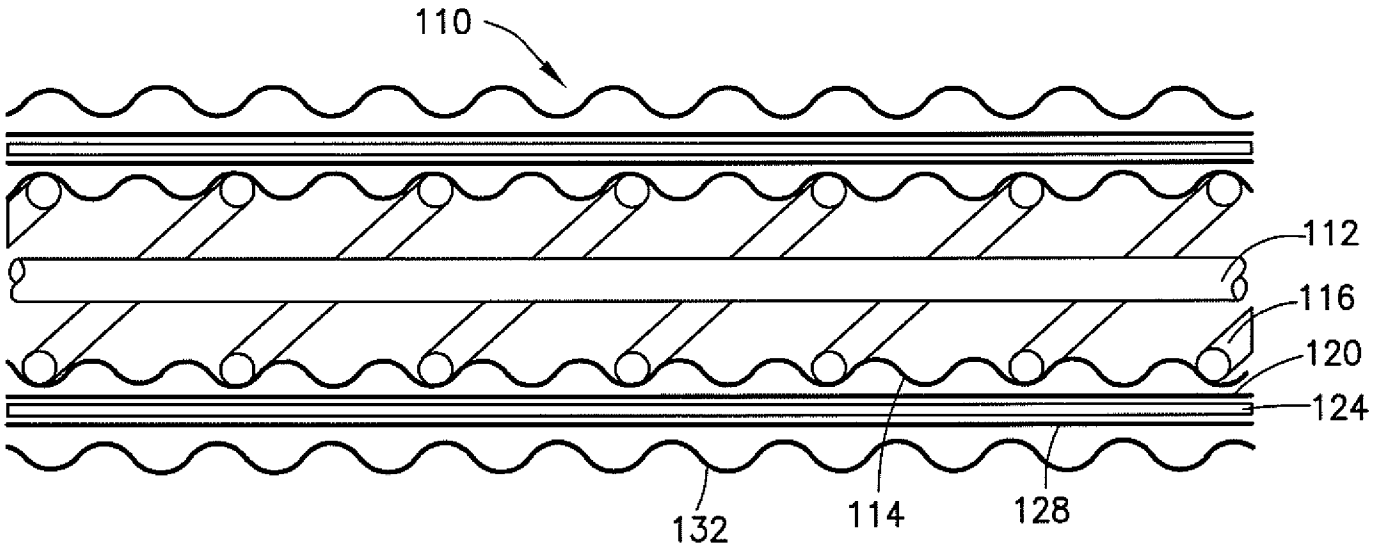
FIG. 5B is a schematic view of the example embodiment of FIG. 5A without a jacket.

Referring to FIG. 5B, the cable 110 may be formed and used without the jacket 138.

Figure 6A:
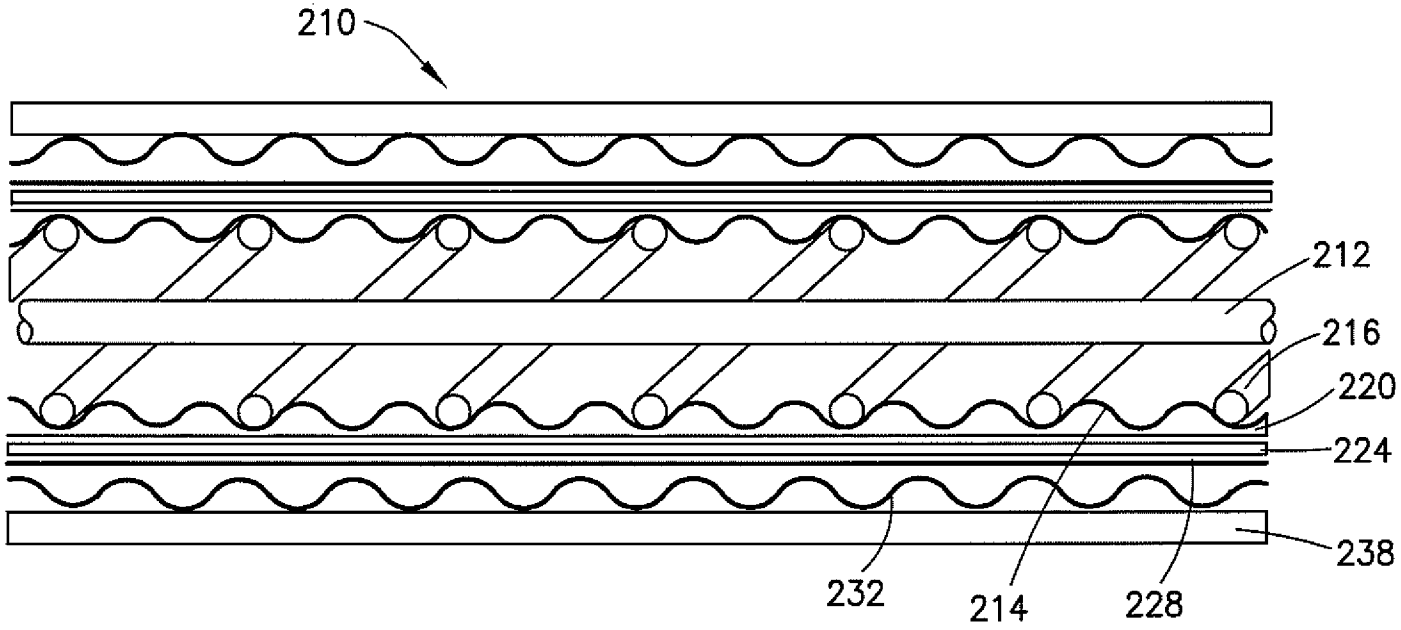
FIG. 6A is a schematic view of another example embodiment of a coaxial cable.

Referring to FIG. 6A, another example embodiment of a coaxial cable is shown generally at 210 and is hereinafter referred to as "cable 210." In cable 210, an inner conductor 212, an outer conductor 214, and a dielectric 216 are similar to previous embodiments.

A first barrier tape 220 in this example embodiment comprises a ceramifiable silicone in tape form. A second barrier tape 224 may be disposed on the first barrier tape 220, the second barrier tape 224 comprising copper, stainless steel, or copper clad stainless steel. A third barrier tape 228 may be disposed on the second barrier tape, the third barrier tape 228 comprising additional ceramic or silica material. A fourth barrier tape 232 on the third barrier tape 228, in this example embodiment, may be stainless steel in a corrugated form. While stainless steel exhibits ability in resisting corrosion, other materials such as copper, copper alloy stainless steel or copper clad stainless steel may also be used. Corrugations in the fourth barrier tape 232, as well as corrugations in the outer conductor 214, facilitate bending and flexing of the cable 210. A jacket 238 on the fourth barrier tape 232 may be, for example, ethylene acrylic elastomer, PVC, PVDF, FRPE, or the like.

Figure 6B:
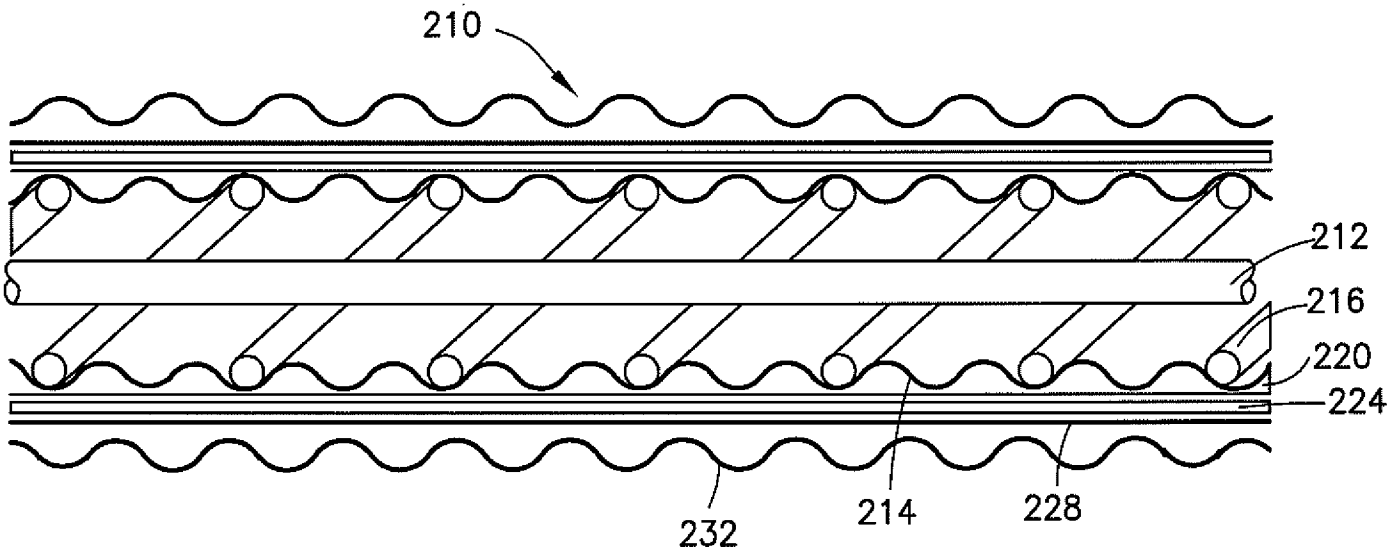
FIG. 6B is a schematic view of the example embodiment of FIG. 6A without a jacket.

Referring to FIG. 6B, the cable 210 may be formed and used without the jacket 238.

Figure 7:
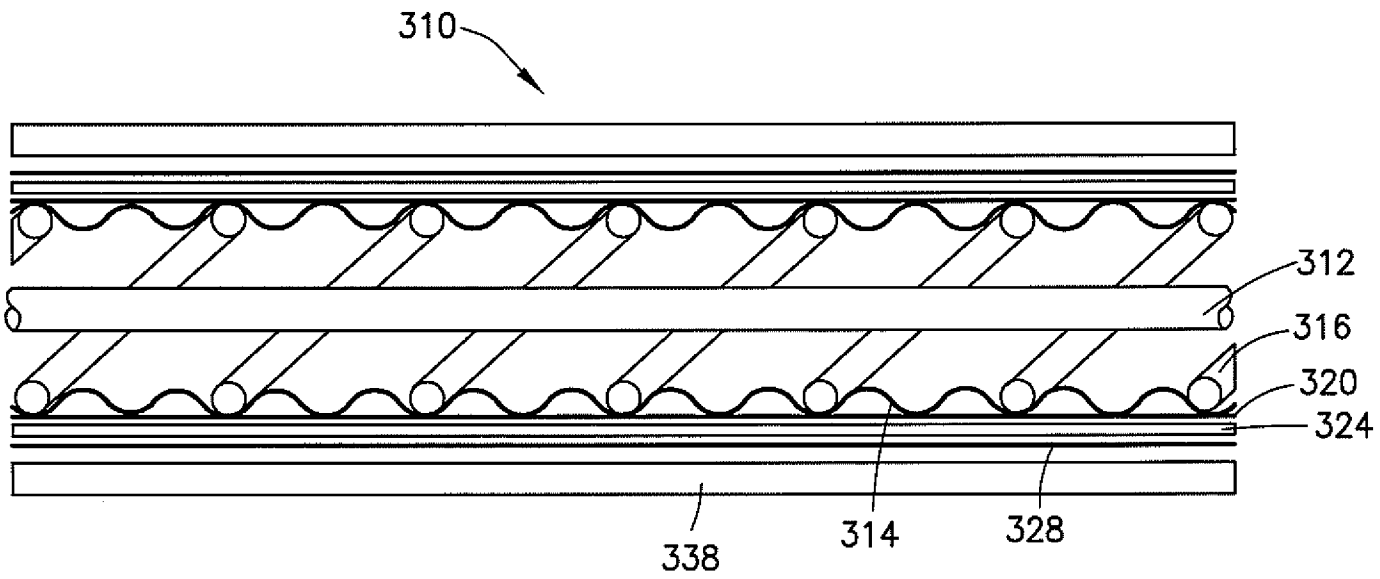
FIG. 7 is a schematic view of another example embodiment of a coaxial cable.

Referring to FIG. 7, another example embodiment of a coaxial cable is shown generally at 310 and is hereinafter referred to as "cable 310." In cable 310, an inner conductor 312, an outer conductor 314, and a dielectric 316 are similar to previous embodiments.

A first barrier tape 320 on the outer conductor 314, in this example embodiment, comprises silica. A second barrier tape 324 may be disposed on the first barrier tape 320, the second barrier tape 324 comprising copper, stainless steel, or copper clad stainless steel. A third barrier tape 328 may be disposed on the second barrier tape, the third barrier tape 328 comprising additional ceramic or silica material. A jacket 338 may be disposed directly on the third barrier tape 328, the jacket 338 comprising, for example, ethylene acrylic elastomer, PVC PVDF, FRPE, or the like.

Figure 8:
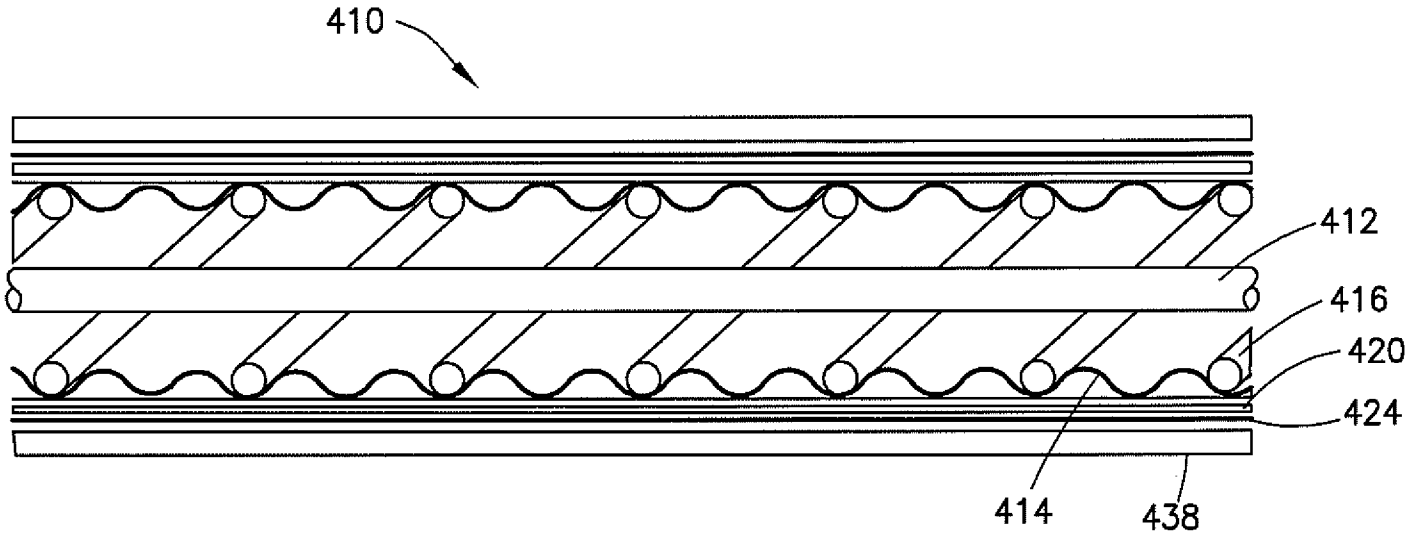
FIG. 8 is a schematic view of another example embodiment of a coaxial cable.

Referring to FIG. 8, another example embodiment of a coaxial cable is shown generally at 410 and is hereinafter referred to as "cable 410." In cable 410, an inner conductor 412, an outer conductor 414, and a dielectric 416 are similar to previous embodiments.

A first barrier tape 420 on the outer conductor 414, in this example embodiment, comprises silica. A second barrier tape 424 may be disposed on the first barrier tape 420, the second barrier tape 424 comprising copper, stainless steel, or copper clad stainless steel. A jacket 438 may be disposed directly on the second barrier tape 424, the jacket 438 comprising, for example, ethylene acrylic elastomer, PVC, PVDF, FRPE, or the like.

Figure 9:
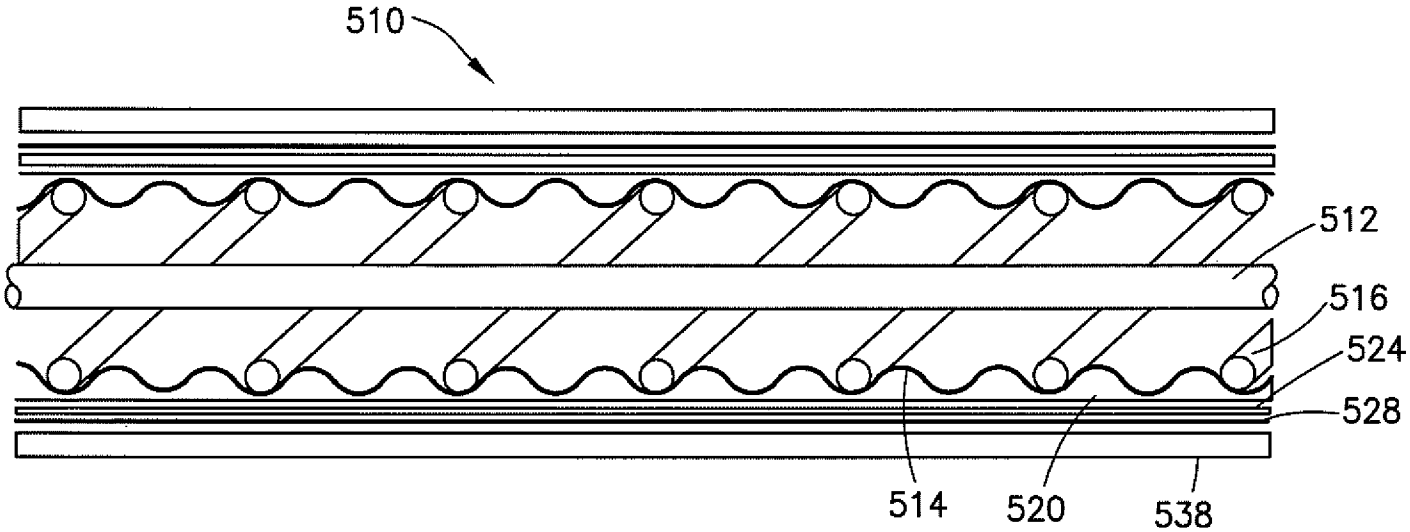
FIG. 9 is a schematic view of another example embodiment of a coaxial cable.

Referring to FIG. 9, another example embodiment of a coaxial cable is shown generally at 510 and is hereinafter referred to as "cable 510." In cable 510, an inner conductor 512, an outer conductor 514, and a dielectric 516 are similar to previous embodiments. This example embodiment, however, illustrates a 3-conductor cable.

A first barrier tape 520 in this example embodiment comprises a ceramifiable silicone in tape form. A second barrier tape 524 may be disposed on the first barrier tape 520, the second barrier tape 524 comprising copper, stainless steel, or copper clad stainless steel. A third barrier tape 528 may be disposed on the second barrier tape, the third barrier tape 528 comprising additional ceramic or silica material. A jacket 538 on the third barrier tape 528 may be, for example, ethylene acrylic elastomer, PVC, PVDF, FRPE, or the like.

In one example embodiment, a cable comprises an inner conductor; a dielectric arranged around the inner conductor; an outer conductor annularly arranged around the dielectric; a plurality of tapes around the outer conductor, each tape providing a successive layer over and circumferentially surrounding an underlying tape or the outer conductor, wherein one of the tapes is a conductor; and a jacket encasing the plurality of tapes.

The inner conductor may comprise copper or copper alloy. The dielectric may comprise ceramic, silica, or a hybrid of ceramic and silica. The dielectric may comprise a rope helically wound along a length of the inner conductor. The outer conductor may comprise copper, corrugated copper, or copper clad stainless steel. The plurality of tapes may comprise a first tape, a second tape, a third tape, and a fourth tape, each of the tapes substantially covering an underlying tape or the outer conductor. The first tape may comprise ceramic, silica, or ceramifiable silicone, the second tape may comprise copper, stainless steel, or copper clad stainless steel, the third tape may comprise ceramic or silica, and the fourth tape may comprise stainless steel. The jacket may comprise a fire retardant material.

In another example embodiment, a fire rated multiconductor cable comprises a conductor, a plurality of concentrically arranged temperature resistive tapes covering the conductor, wherein one of the temperature resistive tapes is a further conductor, and a protective jacket concentrically arranged to cover the plurality of temperature resistive tapes. The conductor comprises a first conducting material comprising a wire or tube, a second conducting material annularly arranged around the first conducting material, and a dielectric configured as a rope and helically wound in an annular space between the first conducting material and the second conducting material.

The dielectric may comprise ceramic, silica, or a hybrid of ceramic and silica. The dielectric may be configured as a rope helically wound around the first conducting material. The plurality of concentrically arranged temperature resistive tapes may comprise a first tape comprising ceramic, silica, or ceramifiable silicone, a second tape comprising copper, stainless steel, or copper clad stainless steel, a third tape comprising ceramic or silica, and a fourth tape comprising metal alloy. The jacket may comprise an ethylene copolymer, polyvinyl chloride, polyvinylidene difluoride, or fire-resistant polyethylene. The plurality of concentrically arranged temperature resistive tapes may protect the conductor from oxidation and water intrusion. The fourth tape may function as a ground conductor for the conductor.

In another example embodiment, a temperature resistive covering for a multiconductor cable comprises a first tape layer of ceramic or silica covering the multiconductor cable; a second tape layer of metal or metal alloy covering the first tape layer of ceramic or silica; a third tape layer of ceramic or silica covering the second tape layer of metal or metal alloy; a fourth tape layer of metal alloy covering the third tape layer of ceramic or silica; and a fire retardant jacket covering the fourth tape layer of metal alloy. The temperature resistive covering is heat resistant up to 1850° F.

The metal or metal alloy of the second tape layer may comprise copper stainless steel, or copper clad stainless steel. The fourth tape layer of metal alloy may comprise stainless steel. The jacket may comprise an ethylene copolymer, polyvinyl chloride, polyvinylidene difluoride, or fire-resistant polyethylene.

LIST OF ABBREVIATIONS USED

AC alternating current
FRPE fire-resistant polyethylene
NFPA National Fire Protection Agency
OD outside diameter
PVC polyvinyl chloride
PVDF polyvinylidene difluoride
RF radio frequency
UL Underwriter's Laboratory It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications, and variances which fall within the scope of the appended claims.

What is claimed is:

1. A cable, comprising:

an inner conductor;

a dielectric arranged around the inner conductor;

an outer conductor annularly arranged around the dielectric and in contact with the dielectric, wherein the dielectric is arranged to form an air gap between the outer conductor and the inner conductor;

a plurality of tapes around the outer conductor, each tape providing a successive layer over and circumferentially surrounding an underlying tape or the outer conductor, wherein one of the tapes is a conductor; and a jacket encasing the plurality of tapes, wherein the jacket is configured to convert to ash at a defined temperature, wherein the defined temperature is a temperature present in an event of a fire;

wherein the dielectric comprises ceramic, silica, or a hybrid of ceramic and silica;

wherein the dielectric comprises a rope helically wound along a length of the inner conductor;

wherein the plurality of tapes comprises a first tape, a second tape, a third tape, and a fourth tape, each of the tapes substantially covering an underlying tape or the outer conductor; wherein the first tape comprises ceramic, silica, or ceramifiable silicone, the second tape comprises copper, stainless steel, or copper clad stainless steel, the third tape comprises ceramic or silica, and the fourth tape comprises stainless steel;

wherein the jacket comprises a fire retardant material.

2. The cable of claim 1, wherein the inner conductor comprises copper or copper alloy.

3. The cable of claim 1, wherein the outer conductor comprises copper, corrugated copper, or copper clad stainless steel.

4. A fire rated multiconductor cable, comprising:

a conductor comprising, a first conducting material comprising a wire or tube, a second conducting material annularly arranged around the first conducting material, and a dielectric configured as a rope and helically wound in an annular space between the first conducting material and the second conducting material, the dielectric being in contact with both the first conducting material and the second conducting material and at least partially forming an air gap between the first conducting material and the second conducting material;

a plurality of concentrically arranged temperature resistive tapes covering the conductor, wherein one of the temperature resistive tapes is a conductor; and a protective jacket concentrically arranged to cover the plurality of temperature resistive tapes, wherein the protective jacket is configured to convert to ash at a defined temperature, wherein the defined temperature is a temperature present in an event of a fire;

wherein the dielectric comprises ceramic, silica, or a hybrid of ceramic and silica;

wherein the plurality of concentrically arranged temperature resistive tapes comprises, a first tape comprising ceramic, silica, or ceramifiable silicone, a second tape comprising copper, stainless steel, or copper clad stainless steel, a third tape comprising ceramic or silica, and a fourth tape comprising metal alloy;

wherein the jacket comprises an ethylene copolymer, polyvinyl chloride, polyvinylidene difluoride, or fire-resistant polyethylene.

5. The fire rated multiconductor cable of claim 4, wherein the dielectric is configured as the rope helically wound around the first conducting material.

6. The fire rated multiconductor cable of claim 4, wherein the plurality of concentrically arranged temperature resistive tapes protects the conductor from oxidation and water intrusion.

7. The fire rated multiconductor cable of claim 4, wherein one of the temperature resistive tapes functions as a ground conductor for the conductor.

* * * * *